United States Patent [19]

Wang

[11] Patent Number: 4,523,743

[45] Date of Patent: Jun. 18, 1985

[54] AUTOMATIC PNEUMATIC HYDRAULIC JACK

[76] Inventor: Tweng-Huang Wang, Fl. 3-1 no. 80 Hsi-Ning N. Rd., Taipei, Taiwan

[21] Appl. No.: 459,336

[22] Filed: Jan. 19, 1983

[51] Int. Cl.[3] ..... B66F 3/24

[52] U.S. Cl. ..... 254/93 H

[58] Field of Search ..... 254/93 H, 93 R; 60/537, 60/593; 91/4 R, 350, 410

[56] References Cited

U.S. PATENT DOCUMENTS

| | | | |
|---|---|---|---|
| 479,356 | 7/1882 | Farrell | 91/350 |
| 1,903,887 | 4/1933 | Widener | 254/93 H |

*Primary Examiner*—Frederick R. Schmidt
*Assistant Examiner*—Judy J. Hartman
*Attorney, Agent, or Firm*—Holman & Stern

[57] ABSTRACT

An automatic pneumatic-hydraulic jack comprises a mini air compressor and automatic hydraulic jack to serve as an on-vehicle tool wherein the power of the battery on the vehicle is used to drive the mini air compressor which compresses air to serve as its primary force. The air enters an entry channel from an air inlet nozzle and passes to an air chamber via a changeover valve to push a small air-oil piston, thus converting air pressure into hydraulic pressure on the other side of the piston which enters into a large hydraulic cylinder via a check valve and pushes a large piston. The downward movement of the small air-oil piston causes engagement with and turns the changeover valve, thus connecting the air chamber channel to an exhaust channel and the entry channel to the storage tank channel which enables the oil storage tank to supply the small hydraulic cylinder with oil under pressure and make the small air-oil piston move upwards when the small hydraulic cylinder is filled with oil, the small air-oil piston turns the changeover valve to connect the air entry channel to the air chamber channel again, thereby completing the cycle. Such reciprocation converts the air pressure into hydraulic pressure to push the big piston which in turn, jacks up the vehicle. To lower the vehicle, an oil return screw is turned to allow the oil to return to the oil storage tank via a return channel.

4 Claims, 4 Drawing Figures

AUTOMATIC PNEUMATIC HYDRAULIC JACK

BACKGROUND OF THE INVENTION

1. Field of the Invention

This invention relates to a type of automatic pneumatic hydraulic jack which uses compressed air as its motivation power to produce pressure on the hydraulic fluid by which, in turn, according to Pascal's Principle, its total pressure is increased along with the increase of the cross section of the hydraulic cylinder to lift up the vehicle.

2. Description of the Prior Art

Jacks of the type used as on-vehicle tools available at present in general are of two conventional kinds: hydraulic and bolt types, which are all operated by the users and are labor-consuming, time-consuming and inconvenient. Particularly, a female driver often has to manually operate a jack to jack up her vehicle for changing a tire and this is very difficult to do.

BRIEF SUMMARY OF THE INVENTION

The main purpose of this invention is to solve the above-said difficulties, and thus provides a pneumatic automatic hydraulic jack in which it is only necessary to plug in the power supply plug and turn on the air supply switch to automatically jack up a vehicle.

This invention provides an automatic hydraulic jack, especially the type utilizing a combination of both air pressure and oil pressure to serve as an on-vehicle tool; the electric power of the batteries on the vehicle drives a D.C. motor to power a mini air compressor which thus generates the compressed air to serve as the primary motive force for this automatic pneumatic hydraulic jack. The compressed air enters a channel via an air inlet and passes through a changeover valve into the small hydraulic cylinder to push the small piston and thus drives the oil in the small hydraulic cylinder into the large hydraulic cylinder, and at the same time, as the small piston moves down to the lower dead point, the small piston engages and turns the changeover valve, thus directing the compressed air to enter the oil storage tank, so that the oil in this tank is under pressure and therefore opens the check valve and passes into the small hydraulic cylinder to push the small piston to the upper dead point, and at the same time engages and turns the changeover valve to let the compressed air enter the small hydraulic cylinder, so that the air pushes the small piston again and forces the oil in the small hydraulic cylinder into the large hydraulic cylinder; in doing this in a cyclic way, it automatically supplies oil, applies pressure on the oil and pushes up the large piston to lift up the vehicle. Its operation is simple and one needs only to turn on the air supply switch, so that it can automatically lift up the vehicle. Evidently, therefore, it is labor-saving, time-saving and convenient.

BRIEF DESCRIPTION OF THE DRAWINGS

Other purposes, structure and function of this invention are described in detail below with reference to the accompanying drawings showing practical examples wherein.

DETAILED DESCRIPTION OF THE INVENTION

Figure 1:
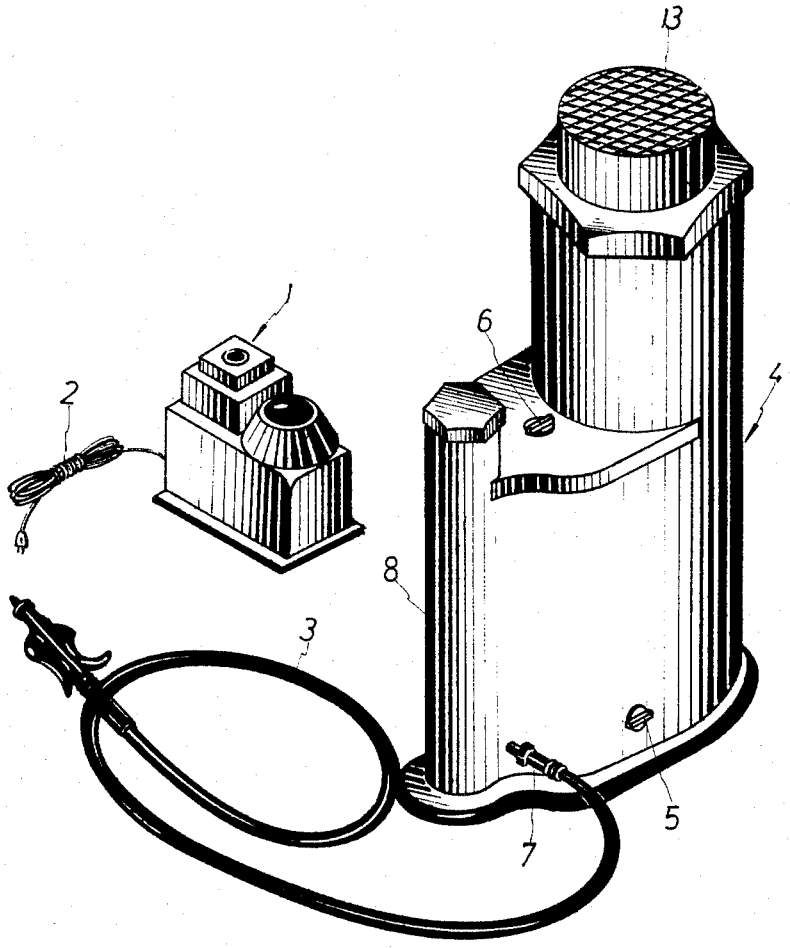
FIG. 1 is a perspective view of this invention.

FIG. 1 shows the outer view of this invention. Items shown include mini air compressor 1, electric power supply line and plug 2, air supply hose 3, automatic pneumatic-hydraulic jack 4, and visible on the outer side of this automatic pneumatic hydraulic jack 4 are oil return screw 5, screw plug in the oil filling port 6, and air inlet nozzle 7.

Figure 2:
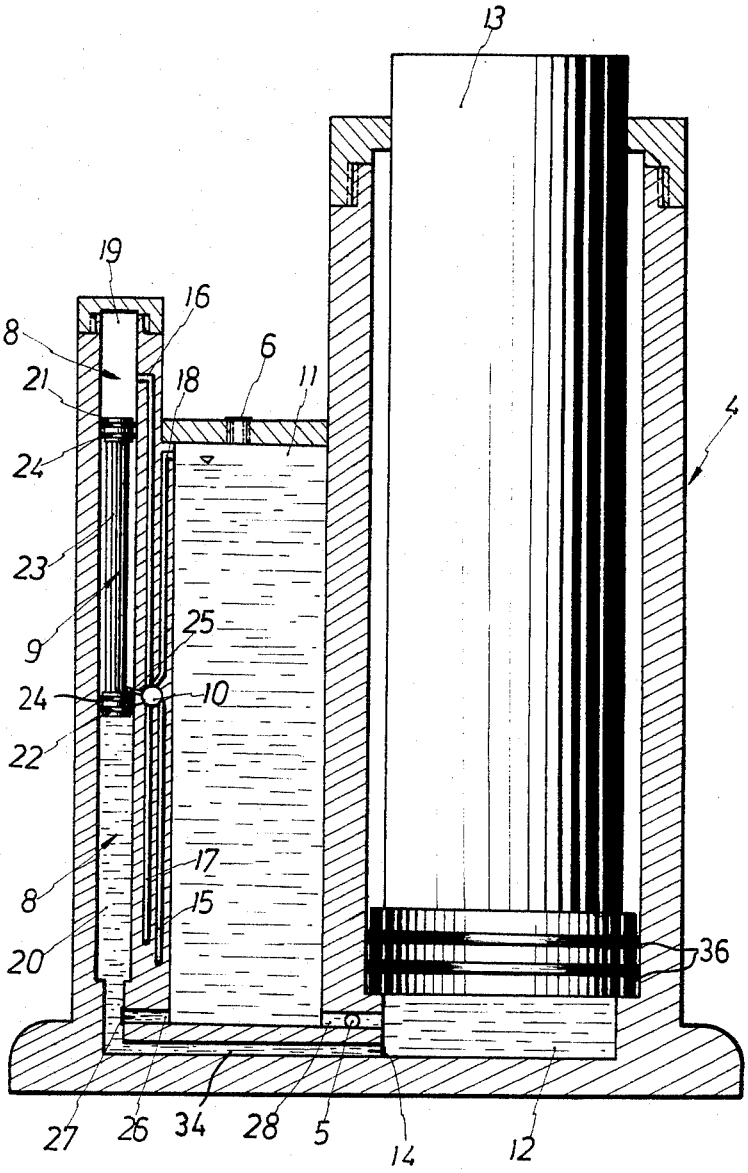
FIG. 2 is a vertical cross-sectional structural view of the automatic pneumatic hydraulic jack of this invention.
Figure 4:
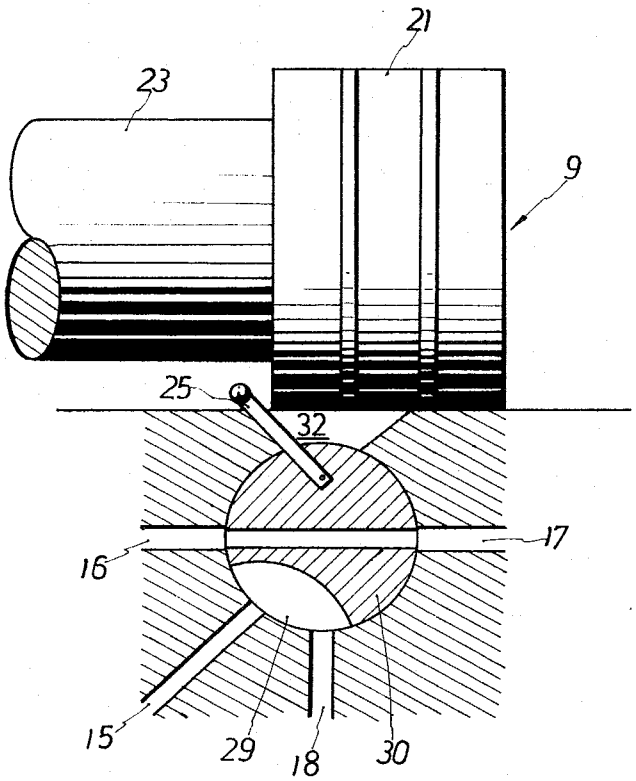
FIG. 4 is a view similar to FIG. 3 showing the connection status between the air entry channel and oil storage tank channel in the changeover valve of this invention.
Figure 3:
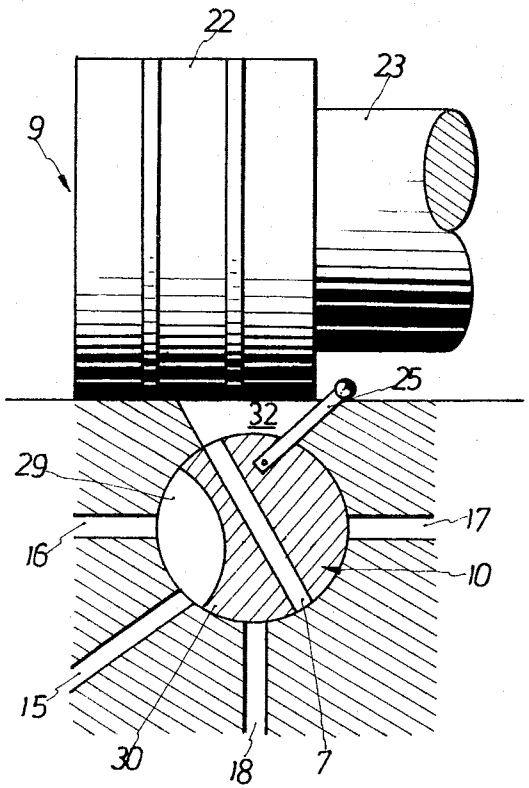
FIG. 3 is an enlarged part cross-sectional view of the connection status between the air entry channel and air chamber channel in the changeover valve of this invention.

FIG. 2 shows the cross-sectional view of the automatic jack of this invention as comprised of air-oil converter 8, small air-oil piston 9, changeover valve 10, oil storage tank 11, large hydraulic cylinder 12, large piston 13, check valve 14, oil entry channel 15, air chamber channel 16, air exhaust channel 17, and oil storage tank channel 18. The air-oil converter 8 is a small-diameter cylinder, the upper part of which is air chamber 19 and the lower part of which is small oil cylinder 20. Small air-oil piston 9 is disposed between air chamber 19 and small oil cylinder 20. This small air-oil piston 9 is composed of upper piston 21 and lower piston 22, connection rod 23 and piston rings 24. Its function is to convert air pressure into hydraulic pressure and also by its sliding up and down, to engage and reverse the action of the changeover valve 10. The valve shifting rod 25 on changeover valve 10 extends through the V-shaped slot 32 into the cylinder of converter 8 and is engaged by the inner ends of upper piston 21 and lower piston 22 (FIGS. 3 and 4). On the right side of air-oil converter 8, as viewed in FIG. 2, is oil storage tank 11 for oil storage and supply, and this tank is connected to small hydraulic cylinder 20 by oil supply channel 26 controlled by check valve 27 in response to pressures on both sides; this tank 11 is also connected to large hydraulic cylinder 12 by oil return channel 28 controlled by the manually operated oil return screw 5. Oil storage tank channel 18 goes to the upper part of oil storage tank 11 from changeover valve 10 and oil is forced into the small oil cylinder therethrough by incoming air pressure. The large hydraulic cylinder 12 has a greater diameter in order to multiply the force many times that in the small hydraulic cylinder and has a check valve 14 to control the flow in channel 34 between it and small hydraulic cylinder 20. In this large hydraulic cylinder 12, a large piston 13 is contained to jack up a heavy object by means of the hydraulic pressure, and in the rear or lower end of this piston, piston rings 36 are provided to effect a tight sealing.

When small air-oil piston 9 is at a position as shown in FIG. 2 and FIG. 3, i.e. at upper dead center, the small hydraulic cylinder 20 on its lower end is fully filed with oil; the compressed air enters from the air entry nozzle 7 into the air entry channel 15 and passes through changeover valve 10 to air chamber channel 16. It then reaches air chamber 19 and applies pressure on the upper end of small air-oil piston 9, making this piston move downward to convert air pressure into hydraulic pressure by forcing check valve 14 to open so that fluid from chamber 20 enters hydraulic cylinder 12, and jacks up piston 13. At this moment, small air-oil piston 9 closes to lower dead center, and the inner end of upper piston 21 has started to engage and turn rod 25 of changeover valve 10 eventually making changeover valve 10 cut off air chamber channel 16 from air inlet channel 15 and connecting it to air exhaust channel 17 for air release. Air entry channel 15 is now connected to oil storage tank channel 18 (FIG. 4), and compressed air enters oil storage tank 11 to apply pressure on the oil and, via oil supply channel 26, forces check valve 27 to open. Thus oil enters small hydraulic cylinder 20 and presses toward lower piston 22 of small air-oil piston 9 to make small air-oil piston 9 close to upper dead center. The inner end of lower piston 22 now starts again to engage and turn rod 25 of changeover valve 10, thus making changeover valve 10 cut off oil storage tank channel 18 and turn to allow air chamber channel 16 to communicate with air inlet channel 15 (FIG. 3) to apply pressure on small air-oil piston 9. This cyclic operation continues until large piston 13 is jacked up to the required height and the air supply switch is turned off. If it is desired to lower piston 13, oil return screw 5 is turned to allow the oil to return to oil storage tank 11 via oil return channel 28.

FIG. 3 shows an enlarged view of the connection status between air entry channel 15 and air chamber 19 in the changeover valve structure and shows the positions of the inner end of lower piston 22 of small air-oil piston 9 and valve shifting rod 25, where, at this moment, air entering from air entry channel 15 goes to air chamber channel 16 via conduit 29 in turning body 30 of the changeover valve to apply pressure on upper piston 21 of small air-oil piston 9.

FIG. 4 shows an enlarged view of the connection status between air entry channel 15 and oil storage tank channel 18 in the changeover valve and shows, due to the downward movement of the upper piston 21, the inner end thereof engages and turns valve shifting rod 25 to the left, where at this moment, the air entering from air entry channel 15 goes to oil storage tank channel 18 via opening or conduit 29 in turning body 30 of the changeover valve to make oil storage tank 11 supply oil to chamber 20 via channel 26 and valve 27. And at the same time, air channel 16 is connected to air exhaust channel 17, thus releasing the pressure in air chamber 19.

Summing up all the above, this invention is simple in structure and easy to operate, practically achieving the labor-saving and time-saving purposes.

I claim:

1. An automatic hydraulic jack comprising:

a large cylinder having a closed end an open end and an inner diameter;

a large piston operably slidably mounted in said large cylinder adapted to protrude at one end through said open end of said cylinder;

a first hydraulic fluid chamber at the closed end of said large cylinder;

hydraulic fluid in said first chamber;

a hydraulic fluid storage tank containing hydraulic fluid;

a first hydraulic fluid flow channel connecting said first chamber with said storage tank;

a manually operated valve in said first flow channel to close said channel during operation of the jack and open said channel after use thereof;

a small cylinder closed at both ends having an inner diameter substantially smaller than the inner diameter of said large cylinder;

a small piston slidably mounted in said small cylinder to reciprocate therein between top and bottom dead center positions comprised of a first end, a second end and a connection rod between said first and second ends holding said first and second ends in spaced relationship with respect to each other and having an outer diameter smaller than the inner diameter of said small cylinder to form an annular chamber between said ends;

an air chamber between said first end of said small piston and the respective end of said small cylinder;

a second hydraulic fluid chamber containing hydraulic fluid between said second end of said small piston and the respective end of said small cylinder;

a second hydraulic fluid flow channel connecting said second chamber to said storage tank;

a one-way valve in said second flow channel adapted to allow fluid from said storage tank to flow into said second chamber;

a third hydraulic fluid flow channel connecting said second chamber to said first chamber;

a one-way valve in said third flow channel adapted to allow hydraulic fluid to flow from said second chamber into said first chamber;

an airflow control valve means operatively mounted adjacent said small cylinder having an air inlet, a first air outlet connected to said air chamber, a second air outlet connected to said storage tank, an exhaust outlet connected to the atmosphere, a control member, a control conduit and an exhaust conduit in said control member, and shifting means on said control member extending into said annular chamber in said small cylinder operatively associated with said small piston to be engageable by said first and second ends thereof as said small piston reciprocates to alternately shift said control member between a power position wherein said air inlet is connected through said control conduit to said first air outlet and a return position wherein said air inlet is connected through said control conduit to said storage tank and said air chamber is connected through said exhaust conduit to said exhaust outlet; and means to supply air under pressure to said air inlet;

so that when said small piston is at top dead center said control member is in the power position and directs pressurized air into said air chamber to drive said small piston in a power stroke to displace hydraulic fluid from said second fluid chamber into said first fluid chamber to operate said large piston, and when said small piston is at bottom dead center said control member is shifted into the return position to direct pressurized air into said storage tank to drive said small piston in a return stroke toward top dead center where said control member is again shifted into a raising position to again operate said large piston.

2. An automatic hydraulic jack as claimed in claim 1 wherein:

said large and small cylinder and said storage tank are in a single housing member;

a common wall of said housing member is disposed between said storage tank and said small cylinder;

said control member is rotatably mounted in said common wall;

a slot is provided in said common wall extending between said control member and said small cylinder; and said shifting means comprises a rod member mounted at one end on said control member and extending through said slot so that it is engageable by the inner surfaces of said first and second ends of said small piston to rotate said control member between said raising and return positons.

3. An automatic hydraulic jack as claimed in claim 2 wherein:

said air inlet, first and second air outlets, and exhaust outlets comprise conduits extending through said common wall;

said storage tank is a closed tank;

said second air outlet conduit is connected to said storage tank at one end thereof;

said first and second hydraulic fluid flow channels are connected at the other end of said storage tank opposite said one end; and a filling port is provided in said storage tank having a removable plug therein.

4. An automatic hydraulic jack as claimed in claim 3 wherein said means to supply air comprises a mini-compressor, and means to connect the outlet of said mini-compressor to said air inlet of said control valve means.

* * * * *